US006340095B1

(12) United States Patent
Walter

(10) Patent No.: US 6,340,095 B1
(45) Date of Patent: Jan. 22, 2002

(54) AUTOMATIC MACHINE FOR DISPENSING MONEY

(75) Inventor: Jürgen Walter, Magstadt (DE)

(73) Assignee: Hess SB - Automatenbau GmbH, Magstadt (DE)

( * ) Notice: Subject to any disclaimer, the term of this patent is extended or adjusted under 35 U.S.C. 154(b) by 0 days.

(21) Appl. No.: 09/403,045

(22) PCT Filed: Apr. 22, 1998

(86) PCT No.: PCT/DE98/01123

§ 371 Date: May 8, 2000

§ 102(e) Date: May 8, 2000

(87) PCT Pub. No.: WO98/48384

PCT Pub. Date: Oct. 29, 1998

(30) Foreign Application Priority Data

Apr. 23, 1997 (DE) ..... 197 17 010
Sep. 3, 1997 (DE) ..... 197 38 521

(51) Int. Cl.[7] ..... G07F 11/28
(52) U.S. Cl. ..... 221/130; 221/129; 221/123
(58) Field of Search ..... 221/123, 129, 221/130, 133, 192, 194, 255, 256, 254, 268, 270, 236, 97, 102

(56) References Cited

U.S. PATENT DOCUMENTS 4,483,459 A * 11/1984 Taylor et al. ..... 221/14
4,717,044 A * 1/1988 Suzuki et al. ..... 221/130
4,745,266 A * 5/1988 Miura ..... 235/379
4,756,449 A * 7/1988 Miura ..... 221/129
4,762,250 A * 8/1988 Friberg ..... 221/123
4,940,162 A * 7/1990 Thie ..... 221/129
5,062,544 A * 11/1991 Buzy-Vigneau ..... 221/130
5,110,009 A * 5/1992 Gartner et al. ..... 221/266
5,127,544 A * 7/1992 Robinson et al. ..... 221/93
5,147,069 A * 9/1992 Dubik ..... 221/79
5,277,330 A * 1/1994 Saussier ..... 221/5
5,318,194 A * 6/1994 Wiese ..... 221/123
5,452,821 A * 9/1995 Heath et al. ..... 221/90
5,632,408 A * 5/1997 Mitchell ..... 221/15
5,761,877 A * 6/1998 Quandt ..... 53/155
5,791,512 A * 8/1998 Kanatsuka ..... 221/2
6,019,247 A * 2/2000 Scott ..... 221/88

FOREIGN PATENT DOCUMENTS

DE 3630191 A1 3/1987
DE 3632108 A1 4/1987
DE 3630191 C2 10/1988
DE 4020546 A1 1/1992
DE 4101809 C1 5/1992
DE 29609900 U1 9/1996

* cited by examiner

*Primary Examiner*—Christopher P. Ellis
*Assistant Examiner*—Rashmi Sharma
(74) *Attorney, Agent, or Firm*—Jones, Tullar & Cooper, P.C.

(57) ABSTRACT

The present invention is directed to a device for dispensing items such as money, preferably rolls of coins. The invention includes at least one magazine for stocking the items and has at least one discharge device for dispensing items. A movable receiving device, which is preferably movable up and down, is provided. The receiving device may further include at least one take-out device wherein the take-out device(s) is extensible for operative engagement with the item and can take an item out of one of the at least one magazine and deposit the item into a removal tray of the receiving device.

15 Claims, 6 Drawing Sheets

AUTOMATIC MACHINE FOR DISPENSING MONEY

Figure 1:
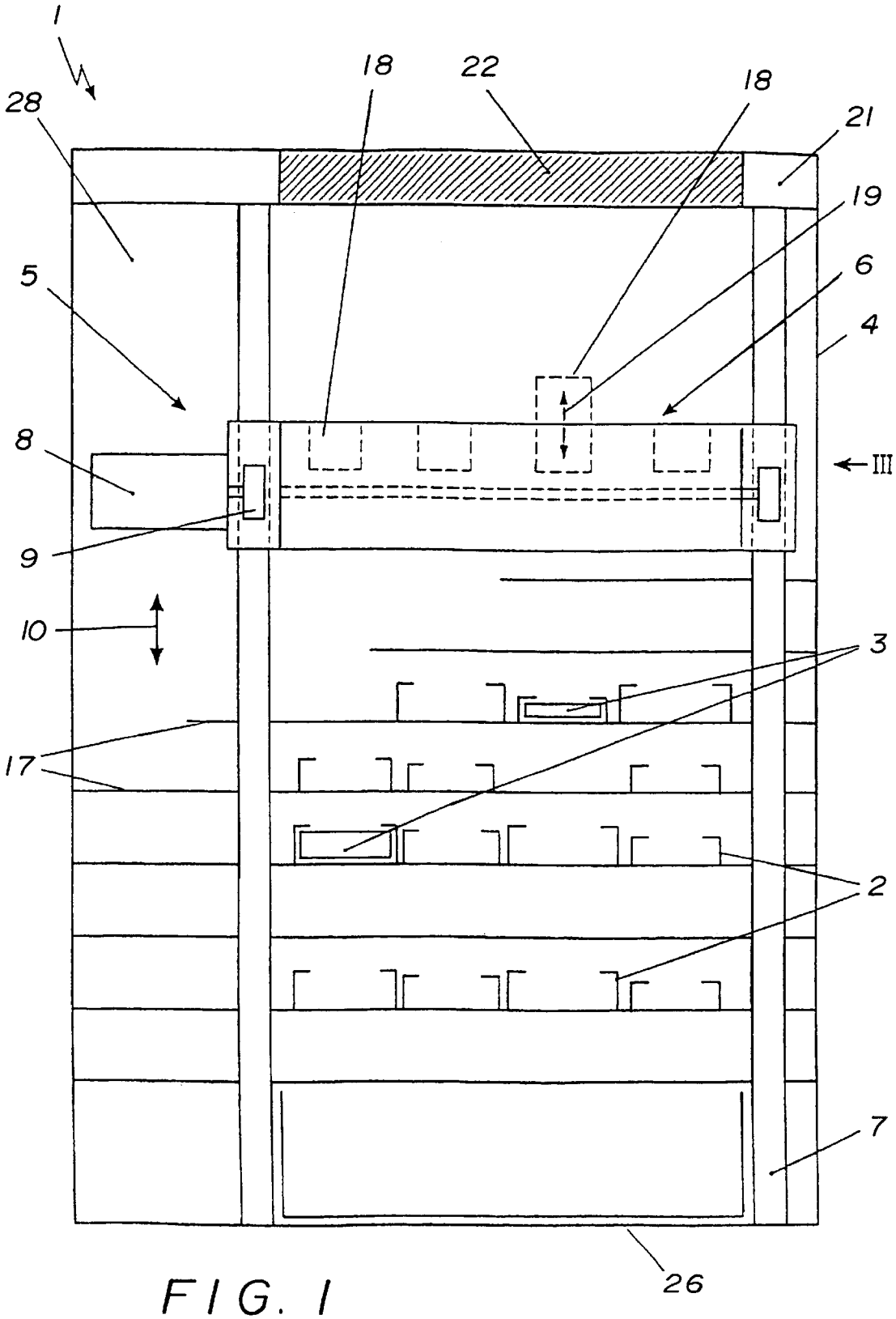

The invention relates to a device for dispensing items (rolls of coins), preferably money, having at least one magazine for stocking the items and having at least one discharge device, for dispensing items from the at least one magazine, in which inside the dispensing device a movable receiving device, which is preferably movable up and down, is provided, near whose path of motion the at least one magazine is disposed with its take-out end, and in which via the at least one discharge device an item can be dispensed from the magazine into the receiving device, when the receiving device is located in the region of the take-out end of the magazine.

One such dispensing device has been disclosed for instance by German Patent DE 36 30 191 C2.

With money dispensing devices, individual coins, rolls of coins, bank notes, or bundles of bank notes can be dispensed. From German Utility Model DE-GM 296 09 900, a device is known for dispensing rolls of coins that are stocked in a storage magazine. Via a drum-like discharge device, a roll of coins is received from the storage magazine and sent through a discharge opening to a take-out tray from which the roll of coins can then be taken by the user. If rolls of coins of different values are to be dispensed, for instance, then a plurality of such dispensing devices must be disposed side by side in modular fashion, and they dispense their rolls of coins into a common tray. Since each dispensing device has complicated dispensing mechanics with many moving parts, and each dispensing operation must additionally be monitored for security reasons, the overall result is a complicated and not very flexible dispensing arrangement. Expanding it or converting it from dispensing rolls of coins to dispensing bank notes or vice versa is practically impossible, or is feasible only at very great effort and expense, in this modular dispensing arrangement.

From German Patent DE 36 30 191 C2 mentioned above, a dispensing device for rolls of coins is already known in which a discharge device is movable vertically for taking rolls of coins out of the magazine. To that end, cam disks with cams are provided on the movable discharge device, by means of which cams the magazine bottom, on which the rolls of coins to be removed rests, can be raised. The roll of coins thus raised via the front wall of the magazine rolls into the bowl-shaped discharge device, which is moved into its upper terminal position so that the rolls of coins removed can be dispensed. This known dispensing device requires the specialized embodiment of the magazine bottoms with raisable parts as well as a complicated mechanical course of motion of the cam disks for dispensing the rolls of coins.

Finally, DE 36 30 191 C2 also cites Japanese Patent Application JP 58 (1983) 1 27 285, from which again a dispensing device is known. For dispensing rolls of coins from a magazine, a rotating finger is used that grasps the frontmost roll of coins from below through a recess in the magazine bottom and lifts it out of the magazine. When such a finger on a movable discharge device is provided, a complicated adaptation must be made between the rotary motion of the finger and the displacement motion of the discharge device, so that the latter moves onward only once a removal operation is concluded and the finger is no longer in a rotary position for removal. The length of the finger must also be adapted to the diameter of the particular coin or coins involved.

In view of this, it is the object of the present invention to simplify a dispensing device of the type defined at the outset in such a way that dispensing is as simple as possible and that flexible, problem-free expansion or conversion with regard to items to be dispensed is possible.

This object is attained according to the invention in that as the discharge device on the receiving device, at least one take-out device that is extensible in operative engagement with the item to be taken out is provided, which when moving past the receiving device can take the item out of the at least one magazine, preferably by raising it. To that end, the take-out device can for instance be moved out of the path of motion of the receiving device, and the magazine can be left open on its take-out end in such a way that the take-out device that has been extended outward can lift the frontmost roll out of the magazine through this opening, while the receiving device is moving past this magazine, preferably upward.

Because the discharge device is provided on the receiving device, a separate discharge device is not needed for every magazine; instead, items can be taken from different magazines with a single discharge device that is movable together with the receiving device. On the magazine itself, no mechanical or electrical adjustments are then necessary, and as a result the magazine can be embodied simply, and can be produced correspondingly economically.

The dispensing device according to the invention operates on a principle of removal and presentation, in which the items to be dispensed to the customer from the dispensing device are first collected inside the dispensing device with the receiving device, in order then to allow the customer to take them out, for instance from above from this receiving device. The receiving device can be displaced horizontally, for instance, or vertically, as is preferred, for instance by means of a lift, and the receiving device is preferably displaced linearly. In the case of a dispensing device that dispenses money, for instance, individual coins, rolls of coins, bank notes and bundles of bank notes and suitably printed receipts can be dispensed into the receiving device, which in particular is provided with a receiving tray. The items to be dispensed need merely be placed in the receiving device, to which end the force of gravity of the items to be dispensed can advantageously be utilized. As the discharge device, known bank note and bundled note dispensing equipment can be used. If money-accepting devices are also provided, then the entire monetary transaction of the kind that is now done in a bank branch can be performed with the device of the invention.

The take-out device is preferably an extensible slide.

In preferred embodiments of the invention, the receiving device is open at the top, so that items dispensed from the magazine are on the one hand securely stored in the receiving device and on the other can easily be taken from above by a user.

If the items located in the at least one magazine are acted upon in the direction of the take-out device of the magazine, for instance via a spring force, then it is assured that an item located in the magazine can in fact be taken out on the take-out end.

As an especially preferred refinement of this embodiment, it is provided that the items located in the at least one magazine are acted upon in the direction of the take-out end of the magazine. By the weight of the magazine, or by the slope descending force, the items in the magazine are then urged in the direction of the take-out end.

To allow the items taken from a magazine to reach the receiving device quickly and reliably, the top side of the take-out device, in its extended position, can have a steeper course than a bottom face, on the take-out side, of the magazine for the items. For instance, if a take-out device lifts the frontmost roll of coins out of a coin bowl magazine, then this inclination assures that the roll of coins will continue to roll downward into the receiving device. The take-out device in its extended position stops the rolls behind it and thus makes it easier to take out the frontmost roll. The next roll of coins in succession, against which the roll that has been removed still rests during the taking-out process, moreover assures that the roll of coins that has been taken out cannot twist but instead is forced outward in parallel. Space can thus be made for other rolls of coins to be removed, and the capacity of the takeout tray can be optimally utilized.

If a plurality of magazines are disposed in succession in the direction of motion of the receiving device, preferably one above the other, then with the same take-out device of the receiving device, for instance, items can be taken from these various magazines. To that end, the takeout device may possibly not have to be retracted completely in the space between these magazines during the motion of the receiving device. Another option for magazine positioning is to put the take-out ends of the magazines in an identical, preferably vertical alignment. For removing rolls of coins from adjacent magazines, the travel path of the take-out device then has to vary only by the difference in diameter of the rolls of coins to be removed in succession, thus further reducing the displacement travel of the take-out device and thus saving time.

Preferably a plurality of magazines are disposed side by side in the direction of motion of the receiving device, and these magazines are provided either with corresponding discharge devices of their own or each cooperate row by row with one common discharge device on the receiving device.

Preferably, a sensor 36 is provided inside the receiving device, by way of which - or with the aid of still other sensors—the instantaneous position of the rolls of coins inside the receiving device can be detected. Thus if there is the risk of blockage, the items that have been received can be dumped out of the receiving device, for instance, and the process of collection and checking can be started over again so that the customer is satisfied. Overfilling of the receiving device can also be detected in time by the sensor.

Quite particularly preferably, the receiving device can be emptied at the bottom, in particular by tilting or uncovering a bottom opening. By tilting or opening the receiving device, it can be assured that if a customer fails to take items out of the dispensing device, the next customer cannot take them instead. This security can be attained for instance by moving the receiving device, after each dispensing operation, into a preferably bottom position in which it then opens at the bottom.

The contents mistakenly located at that time in the receiving device (for instance including foreign bodies thrown in as a prank) can be emptied into a disposal container that can be disposed below the receiving device.

When the magazines are replaced, the items located in the disposal container can be removed; these items can then be assigned to the proper person, if a customer identification has been made during use. This disposal function makes it possible, without informing the customer of it, to correct errors that occur during the process of reception into the receiving device. To prevent causes of mistakes and to further improve the automation, a sensor for automatically identifying the magazine is provided on the receiving device. The magazines, after being filled, are identified by the dispensing device itself, in that the receiving device moves the magazines downward, and thus the most recent status of the magazines is "learned" from the code and the sensor. As a result, the organization operating the dispensing device can configure the outfitting of its equipment with the magazines currently in use. This has the advantage that at busy times, the items most frequently requested can be stocked in greater quantity, and then can be replaced by others again at a later time. Furthermore, it is possible to tell precisely where a given magazine is located at any time, for example when it is being filled or when it is transported, and in the latter case to which branch of the financial institution, and to tell which dispensing device it is located and what the fill level of that device is. The sensor is preferably disposed below the receiving device, so that the customer cannot see it and thus cannot exert any influence it while he is taking out his rolls of coins.

If inclined intermediate bottoms are provided inside the dispensing device, then the magazines, preferably embodied as interchangeable magazines, can be placed easily and conveniently on the intermediate bottoms and secured there. These intermediate bottoms are inclined enough that the items stocked in their various magazines always move toward the take-out end by the slope descending force or that rolling items such as rolls of coins will always continue to roll toward the take-out end. The substantial advantage of these inclined intermediate bottoms is that the capacity of the dispensing device can be adapted to given customer demands by means of a suitable number of intermediate bottoms and rows of magazines, without having to change the technology or the design of the dispensing device. Furthermore, the interchangeable magazines can be removed from the front and the back and equipped, as long as doors are provided on both of these sides, so that the dispensing device can be placed either in a free-standing position or in front of a wall or can be built into a wall. Instead of installing intermediate bottoms for receiving the interchangeable magazines, it is also possible for other dispensing units to be built in separately.

In preferred embodiments, a closable removal opening is provided above a terminal position of the receiving device; after this opening is uncovered, the items located in the receiving device can be taken by a user. The items taken can thus be presented to the customer first, once the entire technical sequence inside the dispensing device is concluded and the receiving device has moved to its terminal position near the opening. As a result, until shortly before the items are taken by the customer, checking operations can still be performed that guarantee to the customer the correctness of the items he has requested. The removal opening can for instance be closable by a slide in a cover of the dispensing device. This slide is not opened so that the customer can take his requested goods until the entire receiving and checking operation is concluded. Thus when the customer takes the items, only the user-friendly receiving device is in front of him, located advantageously at a user-friendly height.

To make mischievous or criminal access to the magazines impossible despite the uncovering of the removal opening, preferably the receiving device is locked in the direction of motion when the removal opening is uncovered.

A coin roll magazine for stocking rolls of coins for the dispensing device described above has at least one guide housing for rolls of coins disposed one after the other; a stop for the frontmost roll of coins to be taken out next; and a removal opening above the frontmost roll of coins. These coin roll magazines are designed such that in their dimensions they are adapted to the length and diameter of the rolls of coins, and they can be disposed in the dispensing device, for instance on intermediate bottoms that are inclined toward the take-out end. This simple design is especially advantageous during transporting, storage (stackability) and in refilling, because the risk of damage is greatly reduced. Magazines for various items, such as rolls of different coins, can be identified visually by giving them different colors. If the coin roll magazines are received only when completely full in a dispensing device, then the capacity of a particular magazine is known, and it is possible at any time to ascertain the current fill level in a dispensing device precisely. A dispensing device can preferably automatically tell an organization operating it when which magazines are empty and should be replaced with full ones. A bottom face of the magazine can be recessed below its removal opening, so that the frontmost roll of coins can be raised from below through the removal opening for removal. The bottom face of the magazine, below the removal opening, and the stop, the latter in a portion of it and particularly in its middle, are preferably open through a common opening, through which a take-out device that can be displaced with an receiving device can take the frontmost roll of coins out of the magazine. To enable the individual magazines and the items contained in them, for instance inside a dispensing device, to be identified automatically, a machine-readable code is placed on the outside of the coin roll magazine. Thus the magazines can be identified, preferably on their front next to the opening, with a machine-readable code that unambiguously identifies the magazine in terms of the type of items it contains.

Quite particularly preferably, the dispensing device, for being filled from its back side, is movable outward toward the front into an automatic machine housing or is rotatable inside an automatic machine housing, so that the dispensing device can be filled with magazines from the backside of the dispensing device.

Further advantages of the invention will become apparent from the description in the drawing. The above-named characteristics and those listed below can also be employed according to the invention individually or multiply in arbitrary combinations. The embodiments shown and described are not to be understood as a conclusive list but instead are of exemplary nature for describing the invention.

Figure 2:
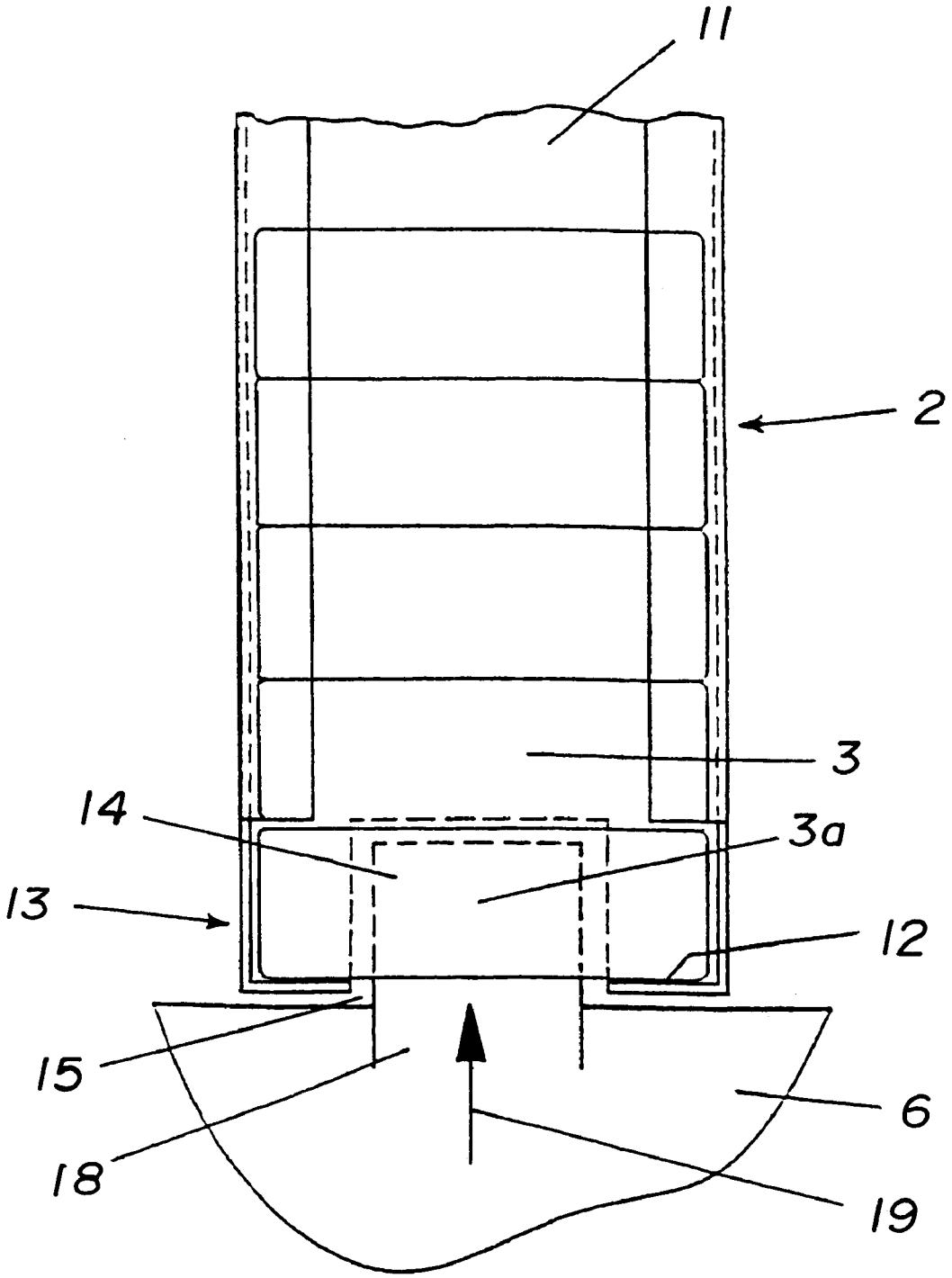
Figure 3:
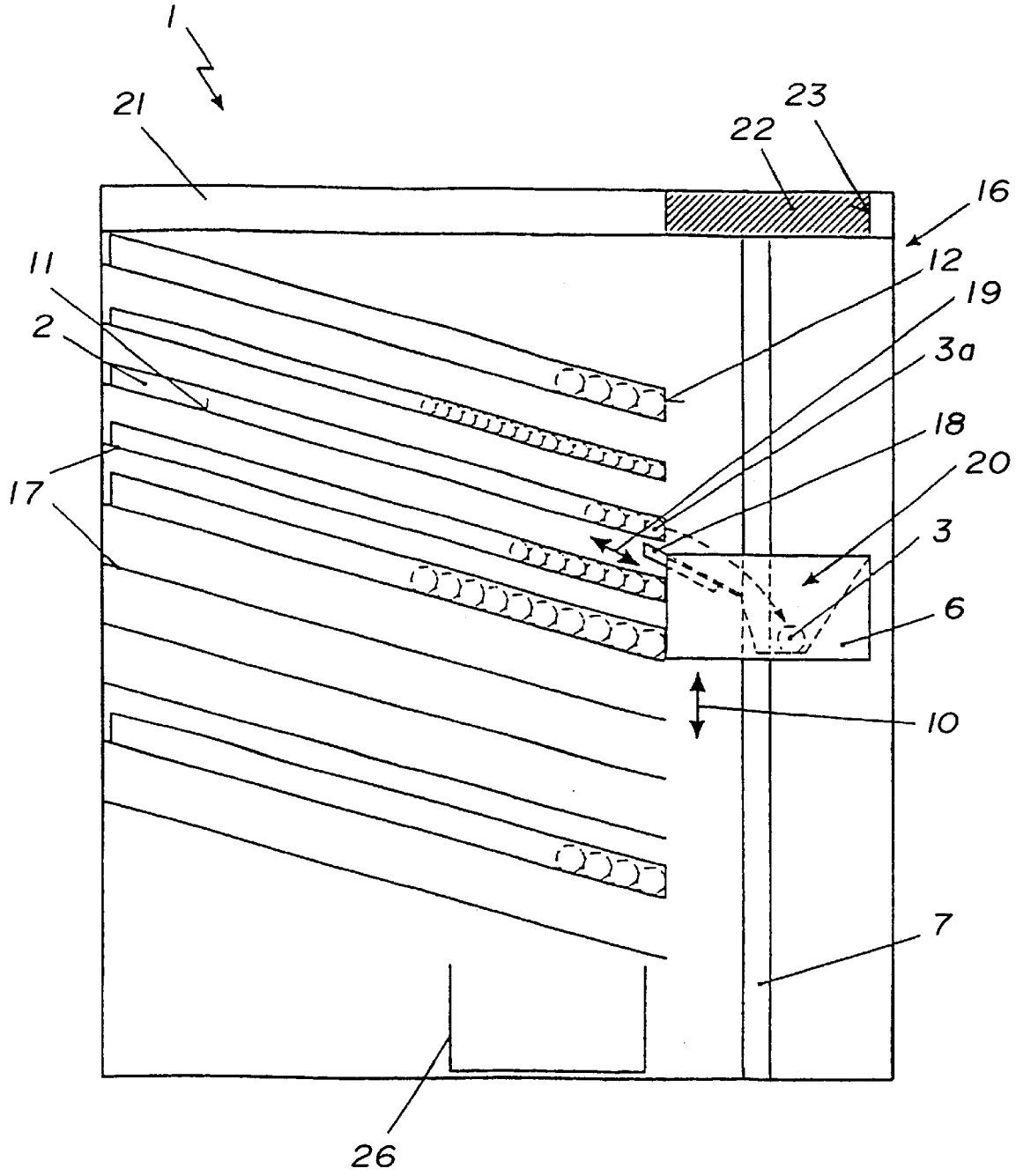
Figure 4:
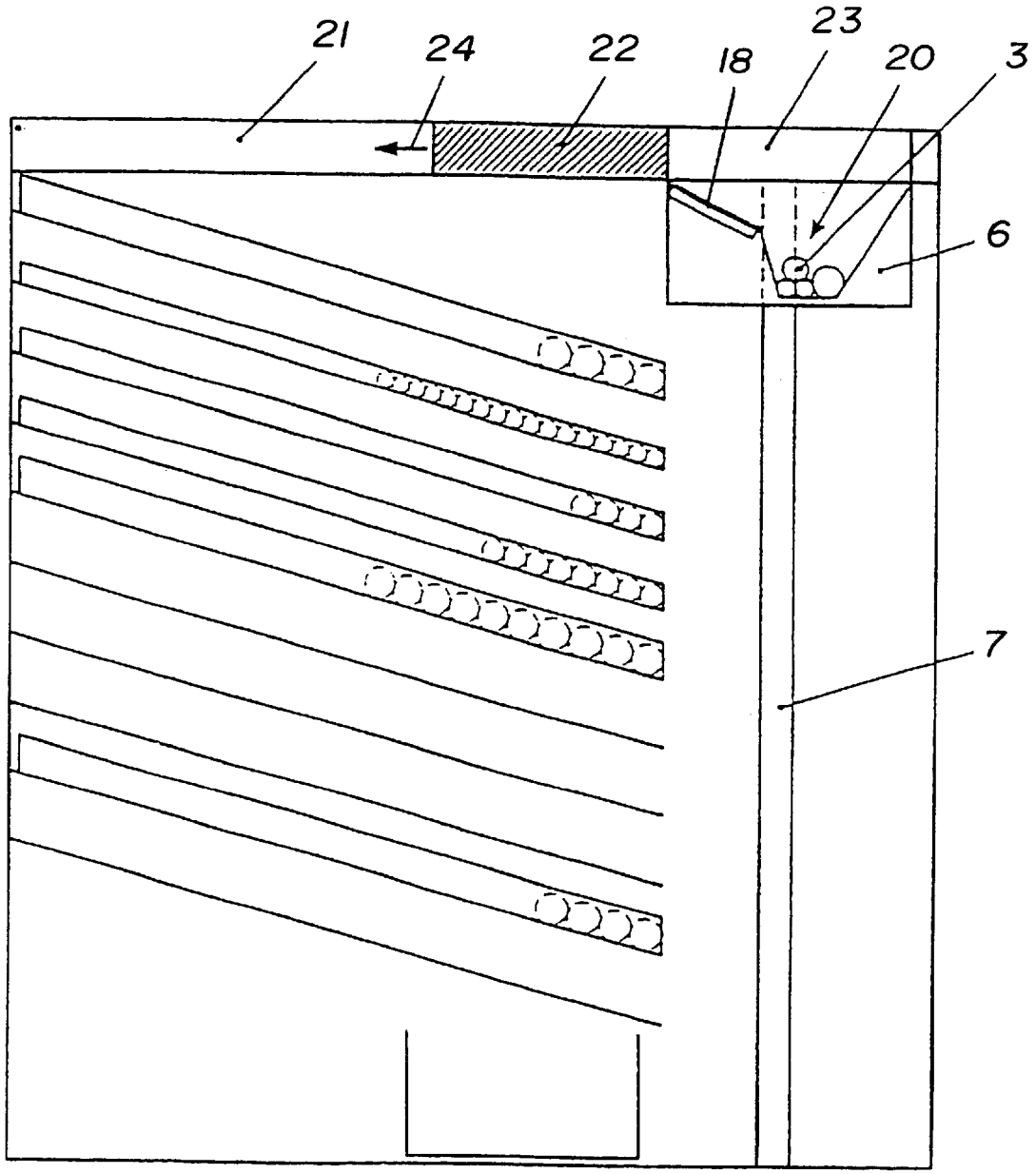
Figure 5:
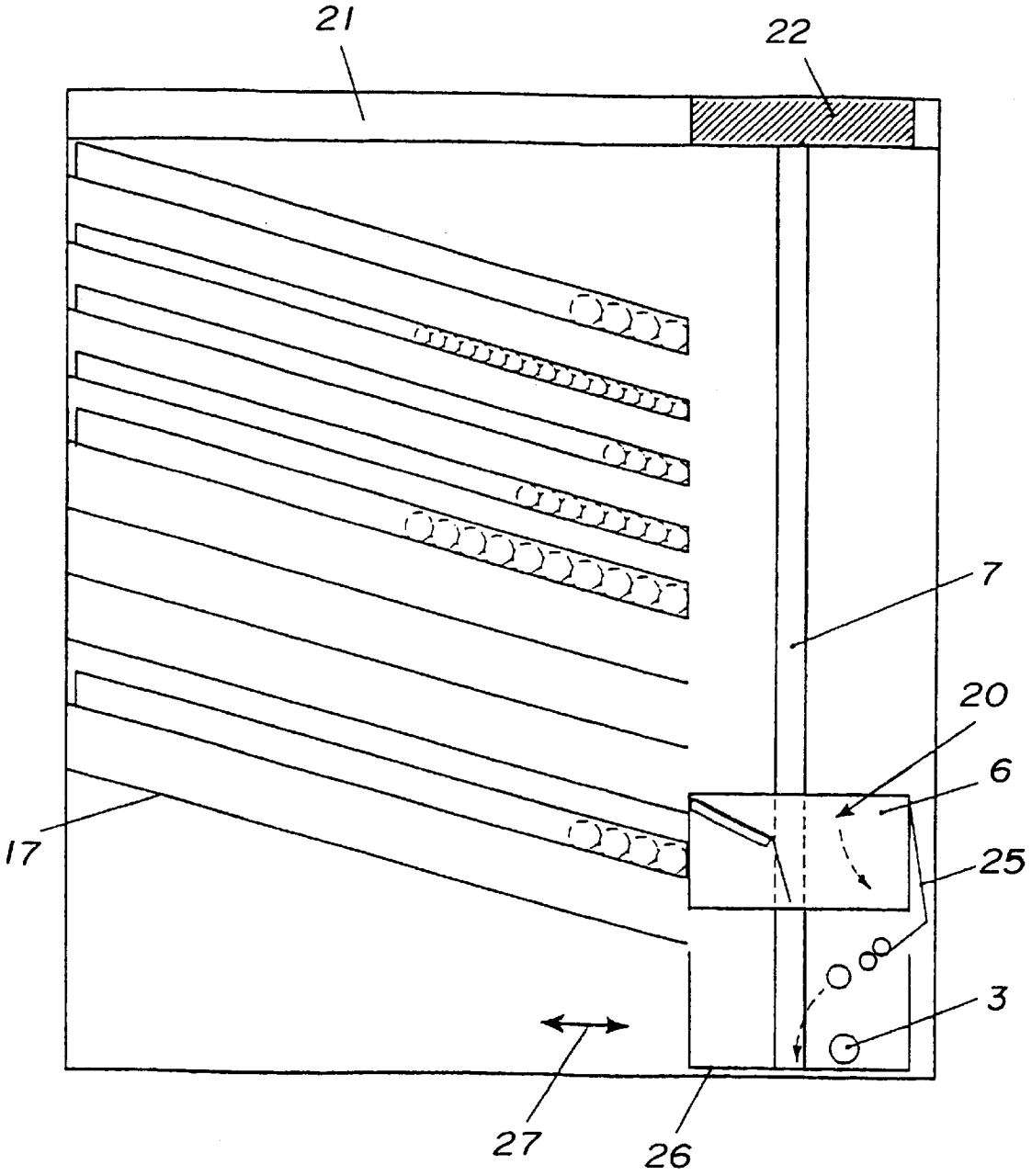
Figure 6:
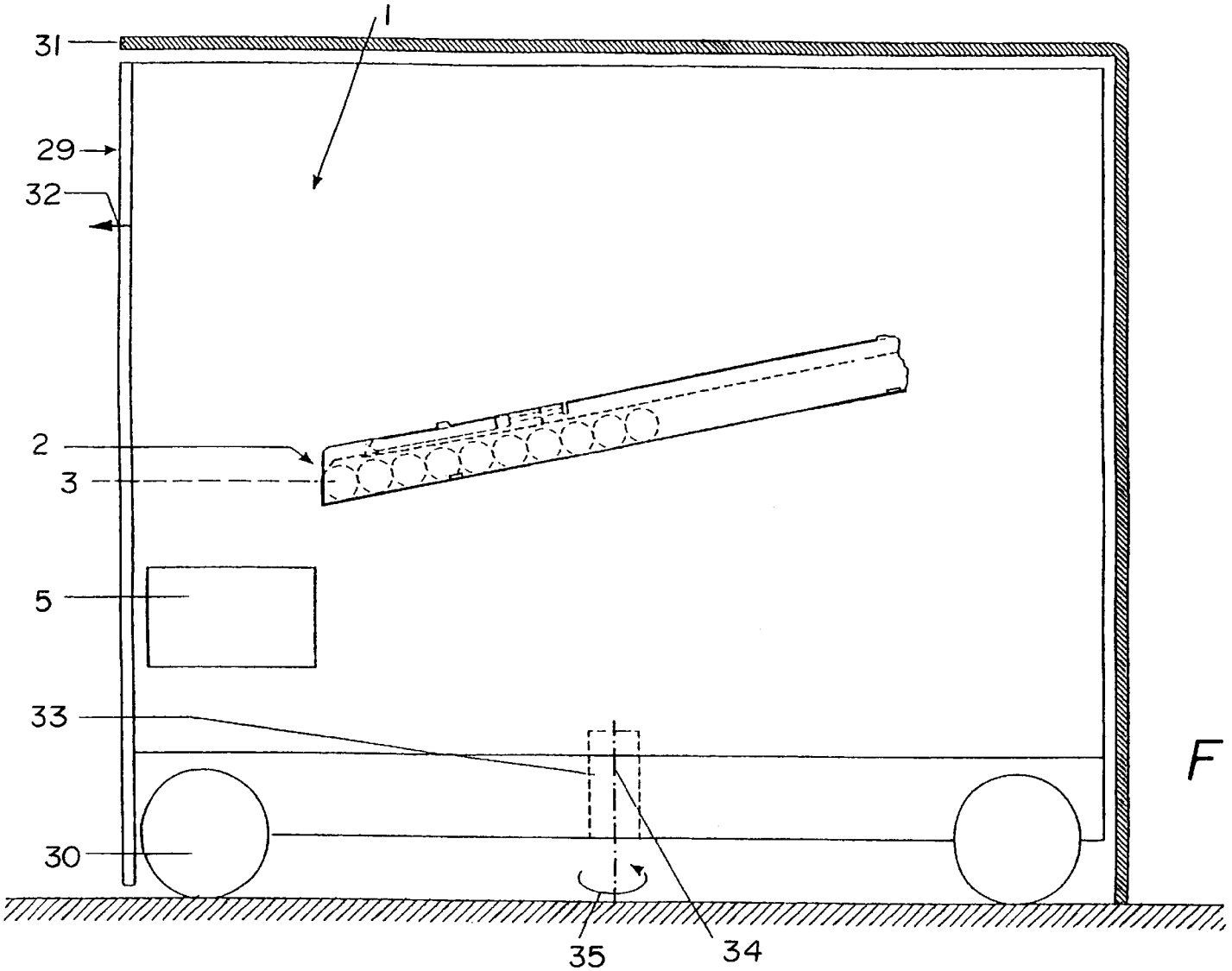

Shown are:

FIG. 1, a front elevation view of the opened dispensing device according to the invention for rolls of coins;

FIG. 2, a plan view on a magazine, filled with coin rolls, in the dispensing device in its take-out region;

FIG. 3, a side view of the dispensing device along the line III of FIG. 1, with a receiving device, which can be displaced for receiving rolls of coins, in a middle position;

FIG. 4, the dispensing device in a side view corresponding to FIG. 3, with the receiving device displaced into its upper terminal position;

FIG. 5, the dispensing device in a side view corresponding to FIG. 3, with the receiving device displaced into its lower terminal position; and FIG. 6, the dispensing device, embodied as a cart that can roll.

The dispensing device shown in the drawing and identified overall by reference numeral 1 serves in the exemplary embodiment shown to dispense coin rolls 3 stocked in magazines 2. The coin rolls 3 to be dispensed to a customer are first collected inside a housing 4 by means of a lift 5 with an associated receiving device 6, so that the customer can then take them out of this receiving device 6 at the top.

The lift 5 is guided vertically via two round toothed racks 7 laterally of the receiving device 6 and can be displaced up an down in the direction of the double arrow 10, together with the receiving device 6, by means of a geared motor 8, which transmits its force to two gear wheels 9 that mesh with the round toothed racks 7. The round toothed racks 7 assure quiet operation, and both driving and guiding are economically achieved with the same components.

As FIG. 2 shows, the magazines 2 are adapted in their dimensions to the length and diameter of the coin rolls 3, in order to form a guide housing for the coin rolls 3 disposed in succession. These rolls rest on a bottom face 11 in the magazine 2; the next coin roll 3*a* to be removed, which is at the front, rests on a front stop 12 of the magazine 2 on the take-out end 13 and can be taken out of the magazine 2 at the top via a removal opening 14. The front stop 12 and the bottom face 11 located below the removal opening 14 are open in their middle through a common opening 15. The magazines 2 are identified on the outside, on their take-out end 13, which a machine-readable code which unambiguously identifies the magazine 2 in terms of the type of coin rolls it contains.

Inside the dispensing device 1, the magazines 2 are located on intermediate bottoms 17, which are inclined (FIG. 3) toward the customer or take-out end 16, so that the coin rolls 3 stocked in the magazines 2 always keep rolling toward the front stop 12 in response to the slope descending force. The magazines 2 are disposed in matrix-like fashion side-by-side and one below the other on the intermediate bottoms 17 and on the take-out end are in an identical vertical alignment up to where they directly adjoin the path of motion of the receiving device 6.

The receiving device 6 is provided with slides, hereinafter called take-out devices 18, which are displaceable in the direction of the double arrow 19 and each form one discharge device. These take-out devices 18 are disposed in accordance with the rows in the magazine matrix and, in their extended state, are capable of taking coin rolls 3 out of the respective magazines 2 during the upward motion of the lift 5. To that end, in the upward motion of the lift 5, the applicable take-out device 18 is moved laterally outward (FIG. 3), before it reaches the height of the desired magazine 2. When the lift 5 moves farther upward out of the path of motion of the receiving device 6, the take-out device 18 reaches through the opening 15 in the bottom face 11 of the magazine 2 and lifts the frontmost coin roll 3*a* out of the removal opening 14. Because the take-out device 18 is inclined more steeply than the intermediate bottoms 17, the raised coin roll 3 rolls along the take-out device 18 downward into a removal tray 20 of the receiving device 6. This process is reinforced by the coin roll 3 following behind, against which the roll being removed still rests during the receiving process and which, by forcing the coin roll outward in parallel, prevents the coin roll from twisting. Sensors (not shown) by way of which the instantaneous location of the coin rolls 3 can be detected and monitored are located inside the receiving tray 20. If a plurality of coin rolls 3 are to be taken from magazines 2 that are located immediately one above the other in one row, then the take-out device 18 need not be retracted completely in the space between these magazines 2 during the upward motion; instead, the displacement travel of the take-out device 18 need merely vary by the difference in diameter between the rolls of coins 3 to be removed in succession.

The housing 4 is closed on its top side by a cover 21, in which a slide 22 is located. This slide does not uncover a removal opening 23, disposed above the receiving device 6 in the cover 21, to allow the customer to take out his desired rolls of coins 3, until the entire collection and checking process has been concluded. Before the slide 22 opens, the lift 5 moves upward, with the coin rolls 3 located in the receiving tray 20, until it contacts the underside of the cover 21, where it is locked against being pressed downward. Next, the slide 22 is displaced in the direction 24 and uncovers the removal opening 23 (FIG. 4).

After each dispensing operation, or in other words after each uncovering of the removal opening 23, the lift 5 is displaced into a bottom position, and the bottom 25 of the receiving tray 20 is opened at the bottom (FIG. 5). The contents of the removal tray 20, such as coin rolls 3 that have not been taken out, are dumped into a disposal container 26, which is located below the removal tray 20 and can be displaced in the direction 27 until it is below the lowermost intermediate bottom 17.

Other additional devices (not shown), such as additional dispensing units for single coins, bank notes, and bundled bank notes, as well as printers for printing receipts, can be disposed on intermediate bottoms 17 or in the open space 28 (FIG. 1) next to the lift 5.

Because of the machine-readable code, with the aid of which each magazine 2 can be identified unambiguously, each magazine 2, preferably designed as an interchangeable magazine, can be disposed on an arbitrary intermediate bottom 17 in an arbitrary row. The magazines 2, after the dispensing device (automatic dispensing machine) 1 has been filled, can be identified themselves in that the lift 5 moves down along the front side of the magazines 2 and thus learns the most recent status of the magazine arrangement and filling, from the codes on them.

To allow the filling of the dispensing device 1 with magazines 2 to be done as simply as possible from the back side of the dispensing device 1, the dispensing device 1 is embodied as a cart 29 on wheels or rollers 30 (FIG. 6), which in the exemplary embodiment shown is pushed in under an automatic machine housing 31 that is open at least at the front. The cart 29, or in other words the entire dispensing device that is open at the back, can be pulled out of the automatic machine housing 31 in the direction of the arrow 32 toward the front for filling; naturally, the cart cannot be pulled out in this way during dispensing operation. The person filling it can control the magazines 2 from the back side, with the cart 29 now pulled out. If there is not enough space at the filling location, then the cart 29, or in other words the entire dispensing device open at the back, which has been pulled out somewhat toward the front in the direction of the arrow 32 can be rotated in the direction of rotation 35 about a pivot axis 34 defined for instance by means of a pivot bearing 33, until the back side of the dispensing device is accessible.

What is claimed is:

1. A device for dispensing one or more items comprising:

at least one magazine for stocking the one or more items, at least one discharge device, for dispensing items from said at least one magazine, a movable receiving device, provided inside the dispensing device and near whose path of motion said at least one magazine is disposed with a take-out end, and at least one take-out device, wherein the one or more items can be dispensed from said at least one magazine, via said discharge device, into said receiving device, when said receiving device is located near the take-out end of said at least one magazine, and wherein said at least one take-out device is extensible for operative engagement with the one or more items and can take the one or more items out of said at least one magazine and depositing the one or more items into a removal tray of said receiving device.

2. The dispensing device of claim 1, wherein the take-out device is an extensible slide.

3. The dispensing device of claim 1, wherein the receiving device is open at the top.

4. The dispensing device of claim 1, wherein the items located in the at least one magazine are acted upon in the direction of the take-out end of the magazine.

5. The dispensing device of claim 4, wherein the at least one magazine is disposed with its take-out end inclined downward in the dispensing device.

6. The dispensing device of claim 1, wherein a plurality of magazines are disposed one above the other.

7. The dispensing device of claim 1, wherein a plurality of magazines are disposed side by side.

8. The dispensing device of claim 1, wherein a sensor is provided inside the receiving device.

9. The dispensing device of claim 1, wherein the receiving device can be emptied at the bottom by dumping it out or by or uncovering a bottom opening.

10. The dispensing device of claim 9, wherein a disposal container can be disposed below the receiving device.

11. The dispensing device of claim 1, wherein a sensor for identifying the magazine is provided on the receiving device.

12. The dispensing device of claim 1, wherein inclined intermediate bottoms are provided inside the dispensing device.

13. The dispensing device of claim 1, wherein a closable removal opening is provided above a terminal position of the receiving device.

14. The dispensing device of claim 1, wherein the receiving device is locked in the direction of motion when the removal opening is uncovered.

15. The dispensing device of claim 1, wherein the dispensing device, for being filled from its back side, is movable outward toward the front into an automatic machine housing or is rotatable inside an automatic machine housing.

* * * * *